US006572291B1

(12) United States Patent
Ho et al.

(10) Patent No.: US 6,572,291 B1
(45) Date of Patent: Jun. 3, 2003

(54) PRINT MEDIA HANDLING SYSTEM AND PRINTER HAVING THE SAME

(75) Inventors: Wai Yuen Ho, Singapore (SG); Baskar Parthasarathy, Singapore (SG)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 09/991,454

(22) Filed: Nov. 16, 2001

(51) Int. Cl.[7] ..... B41J 11/26

(52) U.S. Cl. ..... 400/621.1; 400/621; 400/616.2; 83/423

(58) Field of Search ..... 400/621.1, 621, 400/616, 616.2, 616.3; 83/423

(56) References Cited

U.S. PATENT DOCUMENTS 4,822,190 A * 4/1989 Yokoi ..... 400/613.3
5,092,697 A * 3/1992 McKenna ..... 400/621.1
5,346,321 A * 9/1994 Eudy ..... 400/621.1
5,357,832 A * 10/1994 Ferguson ..... 83/423
5,516,221 A * 5/1996 Lake ..... 400/621.1

FOREIGN PATENT DOCUMENTS

EP 0679522 A2 2/1995

* cited by examiner

*Primary Examiner*—Stephen R. Funk
*Assistant Examiner*—Dave A. Ghatt
(74) *Attorney, Agent, or Firm*—Richard B. Main

(57) ABSTRACT

A print media handling system for feeding print media into a media inlet of a printer is disclosed. The print media handling system includes a media feeder for feeding print media along a media path towards the media inlet. At least one trimming element is disposed along the media path for trimming fed print media to a predetermined width prior to the print media entering the media inlet. A printer that includes a print media handling system described above is also disclosed.

6 Claims, 7 Drawing Sheets

PRINT MEDIA HANDLING SYSTEM AND PRINTER HAVING THE SAME

BACKGROUND

This invention relates, generally, to a print media handling system and more specifically, to a detachable tractor media handling system that trims tractor media to a predetermined width for feeding the tractor media to an attached printer.

Most of present day printers are based either on ink jet or laser technologies. The advancement of these technologies allows ink jet and laser printers to print relatively high quality printouts at a high speed. However, in many lesser-developed countries, dot-matrix printers are still in widespread use. These dot-matrix printers accept fan-fold tractor media. The dot-matrix printers are generally inferior compared to the ink jet and laser printers. The dot-matrix printers are noisy and slow in operation and the quality of the printouts is far inferior. It is only a matter of time that they become obsolete, leaving behind possibly large amounts of tractor media. Accordingly, there is a need to adapt these tractor media for use with ink-jet and laser printers, which typically receives cut-sheet print media of a smaller width than that of the tractor media.

Furthermore, users of cut-sheet print media may want to purchase cut-sheet print media of one size and have the media automatically trimmed to a required size occasionally instead of purchasing media of different sizes.

SUMMARY

According to an aspect of the present invention, there is provided a print media handling system for feeding print media into a media inlet of a printer. The print media handling system includes a media feeder for feeding print media towards the media inlet and at least one trimming element for trimming the print media to a predetermined width prior to the print media entering the media inlet.

According to another aspect of the present invention, there is provided a printer that includes a print media handling system described above.

BRIEF DESCRIPTION OF DRAWINGS

The invention will be better understood with reference to the drawings, in which.

DETAILED DESCRIPTION

Figure 1:
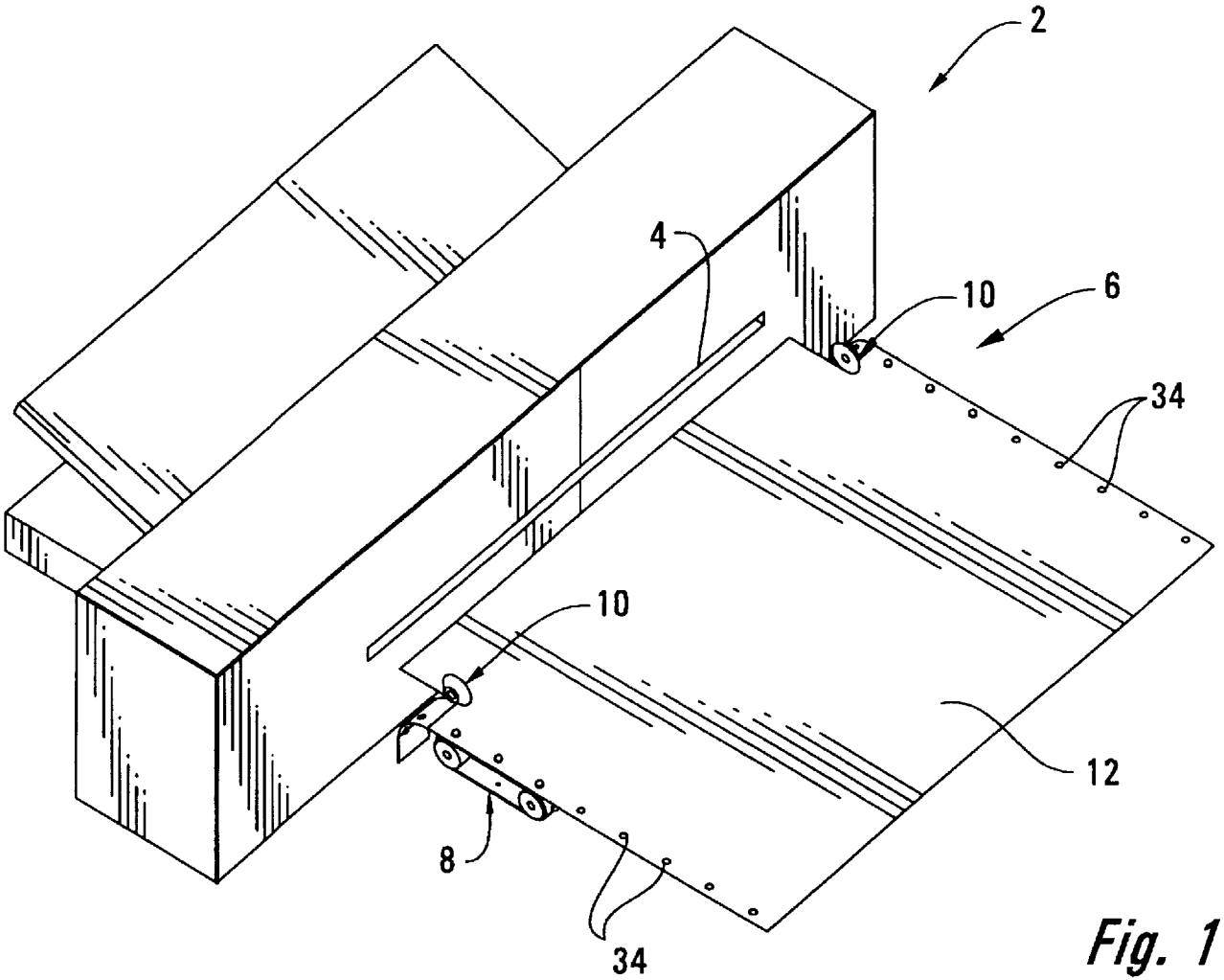
FIG. 1 is a schematic drawing of a printer having a media inlet and a representative print media handling system including a media feeder and a pair of trimming elements.

FIG. 1 is a schematic drawing of a representative printer 2 having a media inlet 4 and a print media handling system

6 according to an embodiment of the present invention. The print media handling system 6, hereinafter referred to as simply the system 6, includes a media feeder 8 and a pair of trimming elements 10. The system 6 may be integral with the printer 2. Alternatively the system 6 may be a detachable unit In either case, the media feeder 8 and the trimming elements 10 preferably derive their movement from a drive source, such as a dive gear 11 (FIG. 3), of the printer 2. Typically, the drive gear is a part of a gear train (not shown) that drives various moveable mechanisms (not shown) of the printer 2 known to those skilled in the art.

When driven, the media feeder 8 feeds print media 12 towards the media inlet 4 of the printer 2. As the print media 12 is fed, the print media 12 engages the trimming elements 10 that are disposed along a media path between the media feeder 8 and the media inlet 4. This engagement of the fed media 12 with the trimming elements 10 allows the trimming elements 10 to trim the print media 12 to a predetermined width for feeding into the media inlet 4. The media feeder 8 may be a cut-sheet feeder or a tractor media feeder as shown in FIG. 1.

Figure 2:
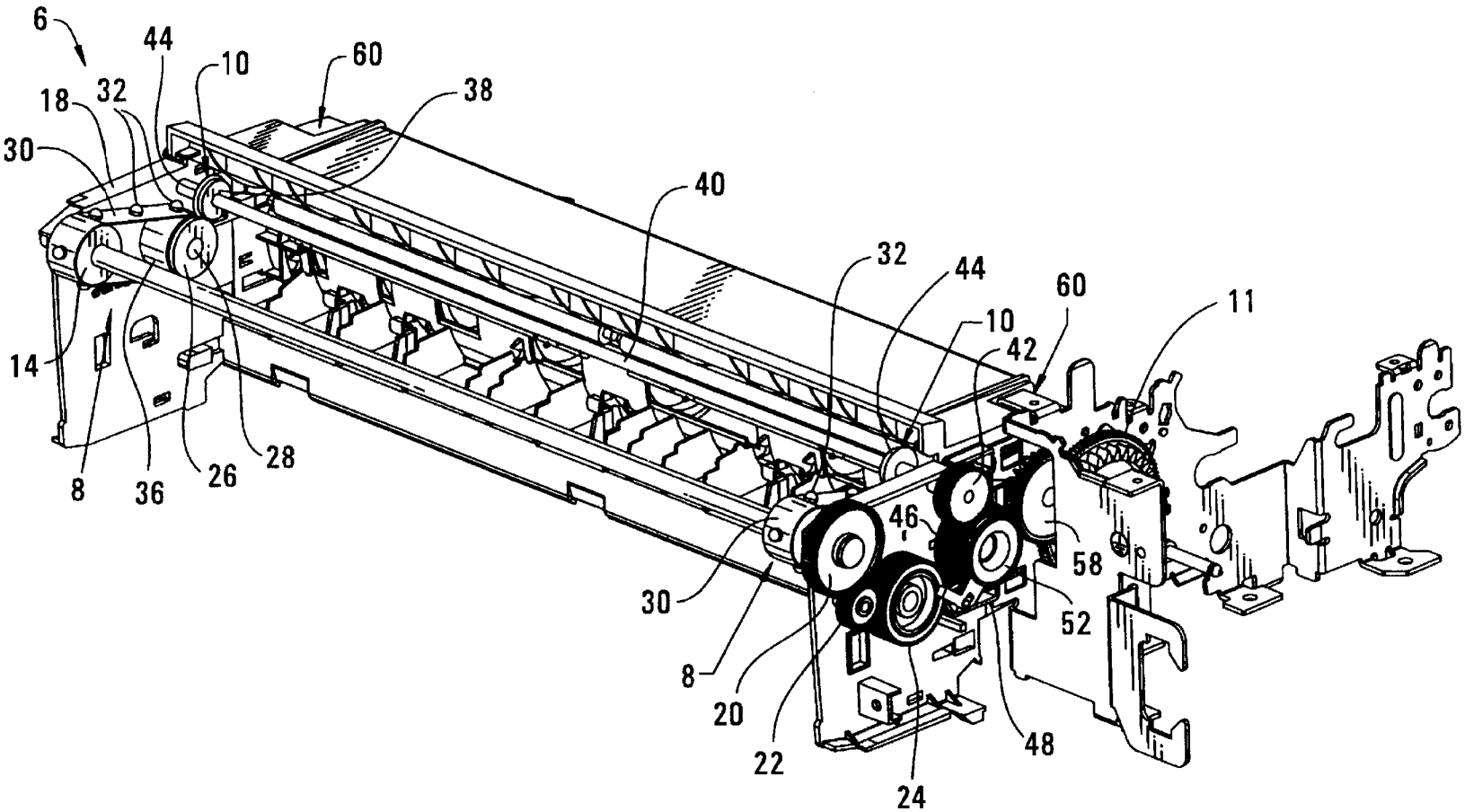
FIG. 2 is an isometric drawing of a detachable print media handling system according to an embodiment of the present invention.

FIG. 2 shows an implementation of the representative print media handling system 6 in FIG. 1. The system 6 in FIG. 2 is a detachable unit that can be attached to the printer 2 when required. The tractor media feeder 8 of the system 6 includes a pair of tractor rollers 14 fixed to a rotateable tractor shaft 16 supported on a frame 18. One end of the tractor shaft 18 has a tractor gear 20 that engages a first idle gear 22. The first idle gear 22 engages a second idle gear 24.

The tractor media feeder 8 also includes two free rollers 26 associated with the tractor rollers 14. The free rollers 26 are mounted to the frame 18 on shafts 28 to freely rotate thereabout. A track 30 encircles each tractor roller 14 and associated free roller 26 pair. The tracks 30 are held sufficiently taut around the tractor roller 14 and free roller 26 pairs to allow the track 30 to be driven by the tractor roller 14. The surfaces of the tractor rollers 14 and the free rollers 26 that come into contact with the track 30 may be grooved in a manner similar to surfaces of timing pulleys. The inner surfaces of the tracks 30 may also be appropriately ribbed to interact with the grooved surfaces to synchronize movement of the two tracks 30 and to prevent track slip. The tracks 30 have guide pins 32 thereon for engaging apertures 34 (FIG. 1) of the tractor media 12. Each of the free rollers 26 includes an annular groove 36 on an outside surface of the free rollers 26. The free rollers 26 act as a support for the tractor media 12 to allow it to be trimmed.

Each trimming element 10 includes a wheel 38 attached to a trimming element shaft 40 that is also supported on the frame 18. The trimming elements are held in close proximity to the media feeder 8. Attached to an end of the trimming element shaft 40 is a trimming element gear 42. When driven, the trimming element gear 42 rotates the trimming element shaft 40 to rotate the two wheels 38. On the rim of the wheels 38 are annular blades 44 for trimming the print media 12. When the trimming element shaft 40 is mounted on the frame, the blades 44 of the trimming elements 10 are disposed in and aligned with the grooves 36 on the free rollers 26. During operation, the blades 44 ride in the grooves to trim the tractor media 12.

Figure 4:
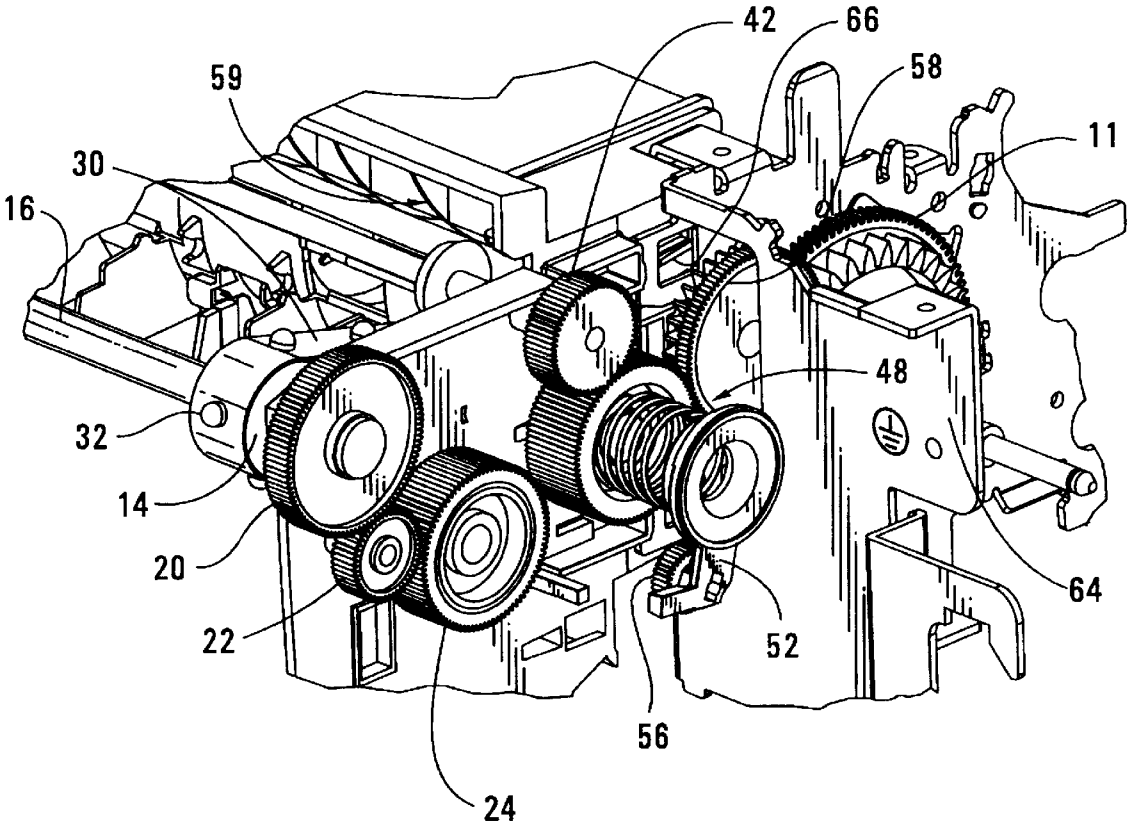
FIG. 4 is an isometric drawing similar to FIG. 3, showing an exploded view of a clutch associated with a control gear of a gear train.

The trimming element gear 42 engages a control gear 46 attached to a clutch 48. FIG. 4 shows an exploded view of the clutch 48. The clutch 48 includes a coil spring 50 and a latching arm 52. The ends of the coil spring 50 are in frictional contact with a cylindrical surface of a bore 54 of the control gear 46 and the latching arm 52 respectively. The latching arm 52 is snap fitted to the bore 54, thereby compressing the coil spring 50 to frictionally couple the latching arm 52 to the control gear 46. Such a coupling allows the latching arm 52 to co-rotate with the control gear 46. When movement of the latching arm 52 is impeded, the latching arm 52 rotates within the bore 54 of the control gear 46. Attached to the latching arm 52 is a planet gear 56 that is in engagement with the control gear 46. The control gear 46 also engages a third idle gear 58. The frame 18 is molded to define a media guide 59.

Figure 3:
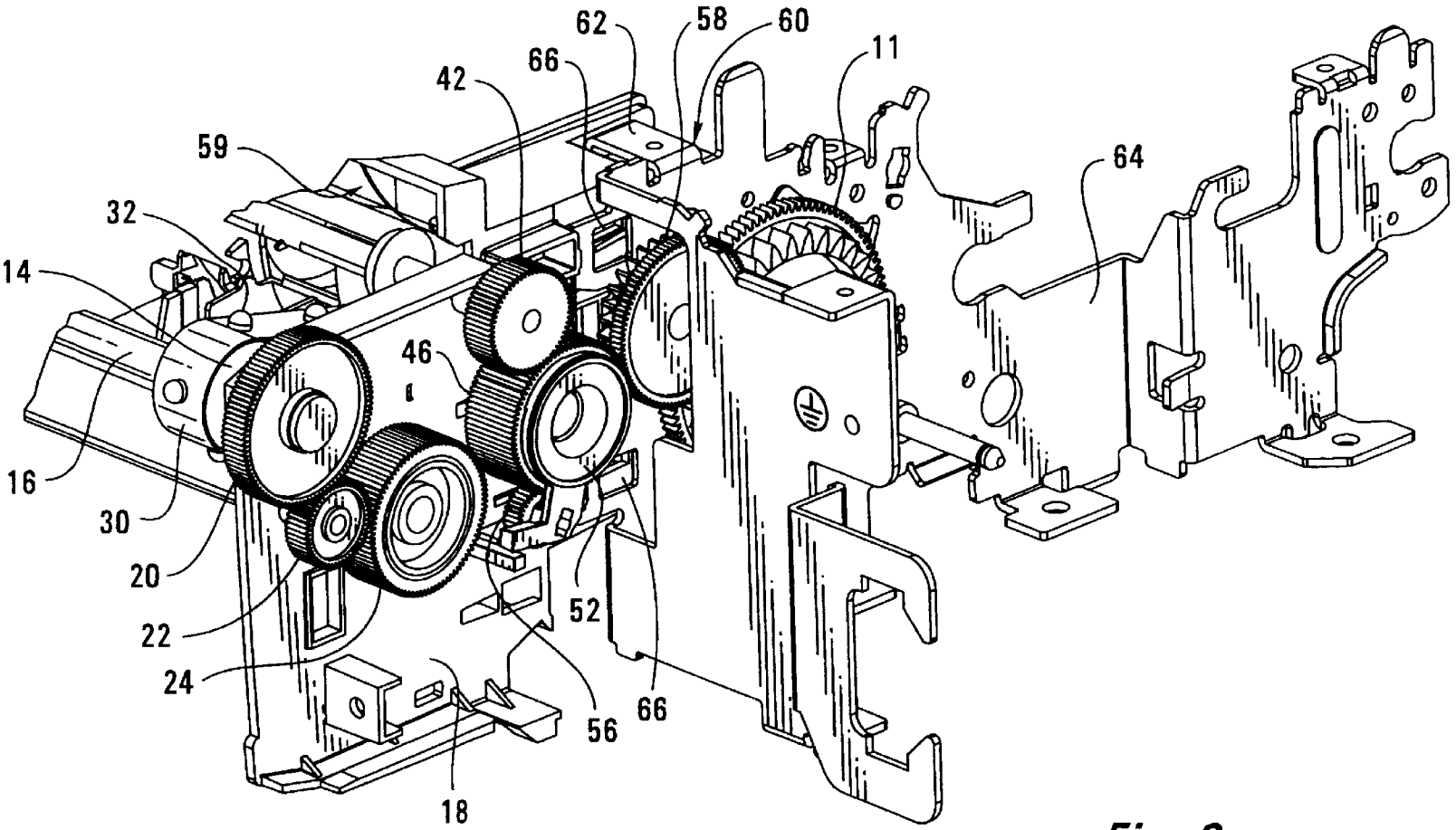
FIG. 3 is an isometric drawing of a portion of the detachable print media handling system in FIG. 2, shown attached to a printer frame.

The detachable print media handling system 6 is attached to the printer 2 by bringing the frame 18 towards the printer 2 until recesses 60 on the frame 18 engage stoppers 62 formed on a printer frame 64 as shown in FIG. 3. Protrusions 66 on the frame 18 also engage corresponding apertures in the printer frame 64 to firmly attach the system 6 to the printer 2. When in this attached position, the third idle gear 58 engages the drive gear 11 of the printer 2.

The operation of the system 6 is next described. To feed and trim tractor media 12 into the media inlet 4 of the printer 6, the third idle gear 58 of the printer 2 is driven in a counter clockwise direction as shown in FIG. 5B. This counter clockwise rotation of the third idle gear 58 drives the control gear 46 in a clockwise direction to thereby rotate the frictionally coupled latching arm 52 in the same direction. The clockwise rotation of the latching arm 52 brings the planet gear 56 to engage the second idle gear 24. The engagement of the planet gear 56 and the second idle gear 24 completes drive transmission from the third idle gear 58 to the tractor gear 20 to allow the tractor rollers 14 to be thereby driven in the clockwise direction as shown in FIG. 5B.

Friction between the tracks 30 and the tractor rollers 14 causes the tracks 30 to rotate to transport loaded tractor media 12 towards the media guide 59. As the control gear 46 rotates, the trimming element gear 42 is driven in the counter clockwise direction to operate the trimming elements 10. As the tractor media 12 travels over the grooves 36 (FIG. 2) under the trimming elements 10, the blades 44 on the trimming elements 10 cut the tractor media 12 to trim the tractor media 12 to the predetermined width. The trimmed tractor media 12 is urged along the media path through the media guide 59 into the media inlet 4 of the printer 2.

Figure 5A:
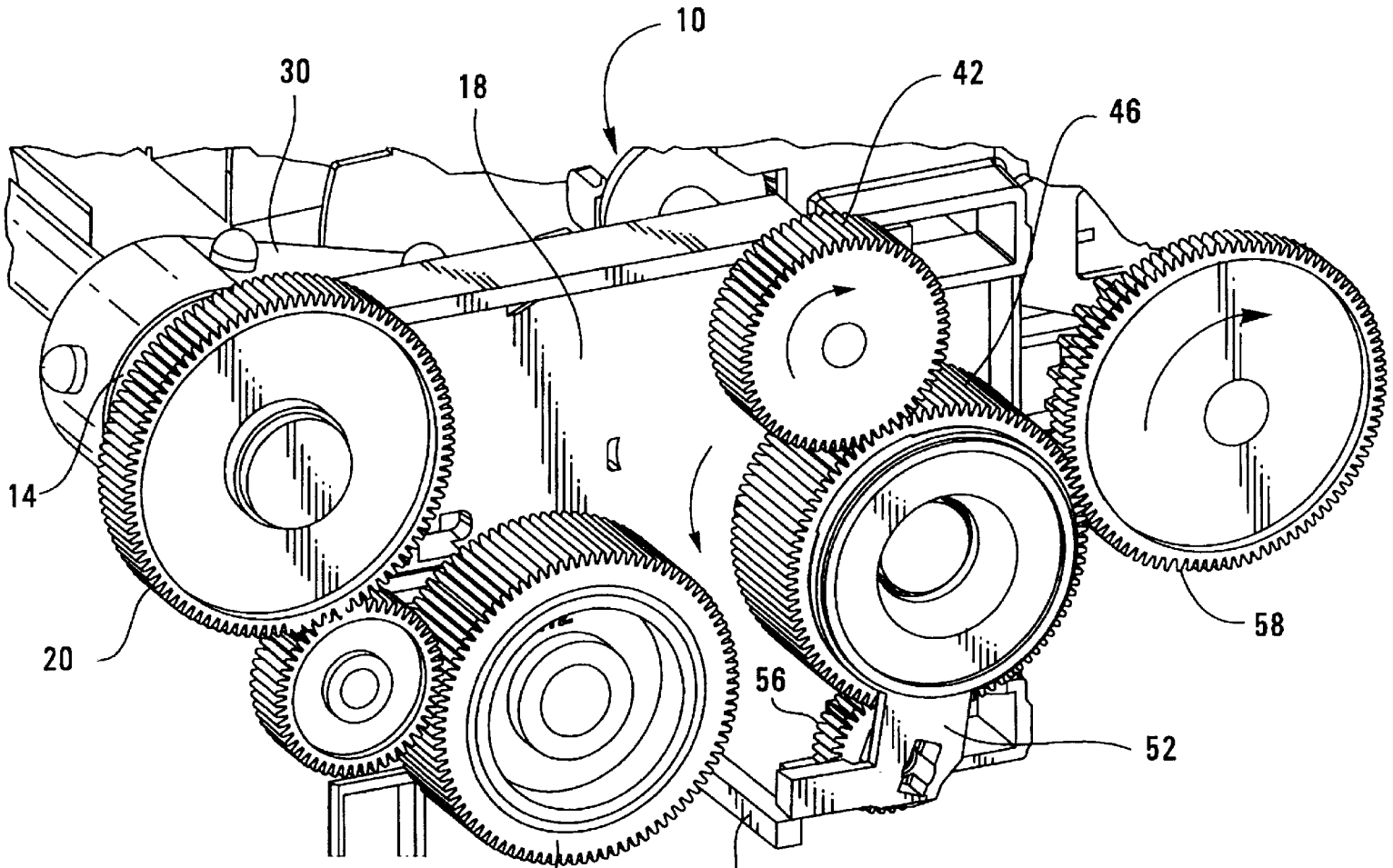
FIGS. 5A and 5B are isometric drawings of the gear train in FIG. 4, showing the clutch in a disengaged and an engaged position respectively.
Figure 5B:
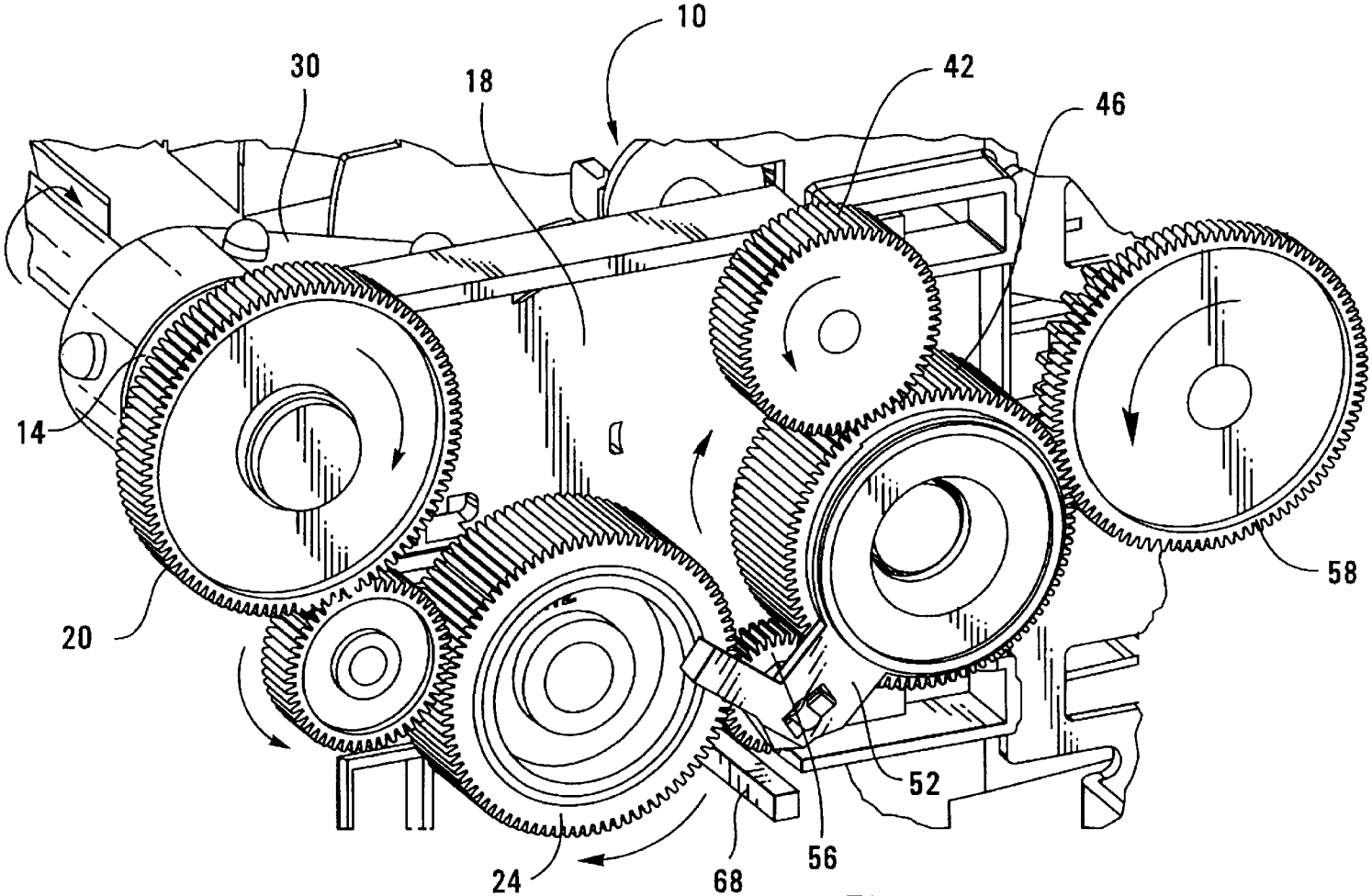

During certain drive sequences of the printer 2, the third idle gear may be driven in the clockwise direction as shown in FIG. 5A. During such drive sequences, the media feeder 8 is prevented from feeding tractor media 12. As the third idle gear 58 is driven in the clockwise direction, the control gear 46 is driven in the counter clockwise direction. The latching arm 52 co-rotates with the control gear 46 in the counter clockwise direction to disengage the planet gear 56 from the second idle gear 24. The latching arm 52 continues to rotate in the counter clockwise direction until a tab 68 protruding from the frame 18 blocks it. Drive transmission from the third idle gear 58 to the tractor gear 20 is thereby interrupted and the tractor rollers 14 will not be driven.

Figure 6:
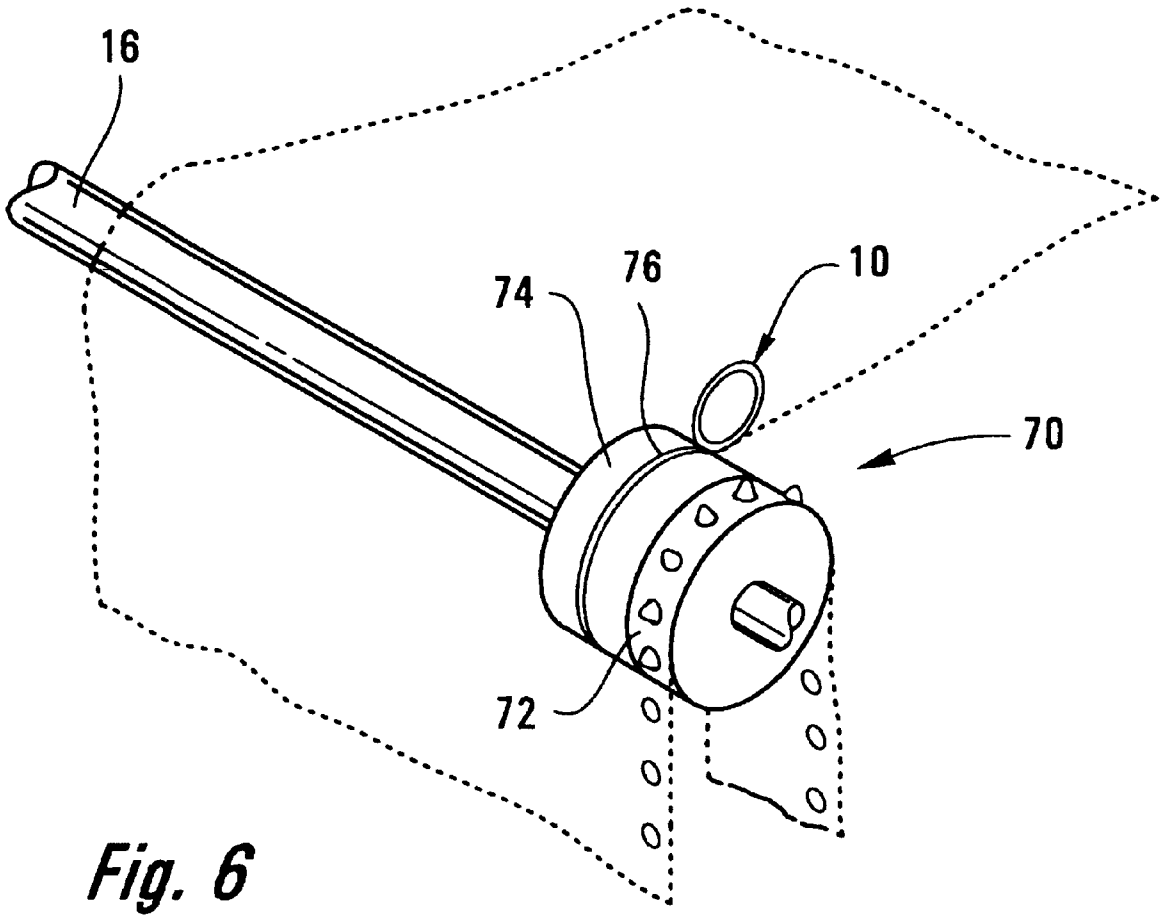
FIG. 6 is an isometric drawing of a representative print media handling system according to a second embodiment of the present invention.

FIG. 6 shows an alternative tractor media feeder 70 according to another embodiment of the present invention. The alternative tractor media feeder 70 includes two tractor wheels 72 (only one of which is shown) mounted on a tractor shaft 16. Also mounted on the tractor shaft 16, adjacent the tractor wheels 72 are two rollers 74 (only one of which is shown). Each of the rollers 74 has an annular groove 76 formed therein for interacting with a trimming element 10. The rollers 74 may be integrally formed with the tractor wheels 72. The operation of such a tractor media feeder 70 is similar to that described above.

Advantageously, with the above print media handling system, media may be automatically trimmed to a predetermined width. Such trimming allows media, such as tractor media that has a width that exceeds the width of a media inlet, to be automatically trimmed to fit the media inlet of a printer.

While the present invention has been shown and described with reference to the foregoing operational principles and preferred embodiments, it will be apparent to those skilled in the art that other changes in form and detail may be made. As an example, in the first embodiment described above, the separate tractor rollers 14 on the tractor shaft 16 may be an integral elongated tractor roller (not shown) having end portions which support the tracks 30. Similarly, the free rollers 26 may also be an integral elongated roller (not shown) having a pair of grooves 36 formed therein to interact with the trimming elements 10.

As another example, the blades 44 of the trimming elements 10 may impinge upon the surface of the free rollers 26 instead of being disposed in the grooves 36. Such a design allows the trimming elements 10 to be slid along the trimming element shaft 40 to adjust their position so that media 12 may be trimmed to a desired width. A print media handling system 6 having only one trimming element 10 is also feasible.

As a further example, the trimming elements 10 may be rotated in either direction instead of the counter clockwise direction shown in FIG. 5B for trimming the media 12.

We claim:

1. A print media handling system for feeding print media into a media inlet of a printer, the printer having a drive source for operating moveable mechanisms of the printer, the print media handling system comprising:

a media feeder for feeding print media towards the media inlet, the media feeder including a tractor media feeder, at least one trimming element in close proximity to the media feeder for trimming the print media to a predetermined width prior to the print media entering the media inlet; and a detachable frame which supports the media feeder and the trimming element, whereby attachment of the frame to the printer allows the media feeder and the trimming element to be driven by the drive source of the printer, wherein the tractor media feeder includes a tractor shaft supported by the frame, a gear fixedly attached to the tractor shaft for rotating the tractor shaft, a pair of tractor wheels mounted to the tractor shaft for engaging and feeding tractor media, and at least one support for interacting with the trimming element to trim the fed tractor media, wherein the media support includes a roller mounted on the tractor shaft, and wherein the roller has an annular groove for allowing a blade of the trimming element to ride therein to trim the fed tractor media.

2. A print media handling system for feeding print media into a media inlet of a printer, the printer having a drive source for operating moveable mechanisms of the printer, the print media handling system comprising:

a media feeder for feeding print media towards the media inlet, the media feeder including a tractor media feeder;

at least one trimming element in close proximity to the media feeder for trimming the print media to a predetermined width prior to the print media entering the media inlet; and a detachable frame which supports the media feeder and the trimming element, whereby attachment of the frame to the printer allows the media feeder and the trimming element to be driven by the drive source of the printer, wherein the tractor media feeder includes a tractor roller, a free roller; and a pair of tracks, each having a plurality of guide pins, encircling end portions of the tractor roller and the free roller for engaging and feeding the tractor media;

wherein the free roller acts as a media support for interacting with the trimming element to trim the fed tractor media.

3. A print media handling system according to claim 2, wherein the free roller has an annular groove that allows the trimming element to ride therein to trim the tractor media.

4. A printer comprising:

a media inlet for receiving print media;

a media feeder for feeding print media towards the media inlet, the media feeder including a tractor media feeder;

at least one trimming element in close proximity to the media feeder for trimming the print media to a predetermined width prior to the print media entering the media inlet; and a drive source for operating moveable mechanisms of the printer, including the media feeder and the trimming element, wherein the tractor media feeder includes a tractor shaft supported by the frame, a gear fixedly attached to the tractor shaft for rotating the tractor shaft a pair of tractor wheels mounted to the tractor shaft for engaging and feeding tractor media, and at least one support for interacting with the trimming element to trim the fed tractor media, wherein the media support includes a roller mounted on the tractor shaft, and wherein the roller has an annular groove for allowing a blade of the trimming element to ride therein to trim the fed tractor media.

5. A printer comprising:

a media inlet for receiving print media;

a media feeder for feeding print media towards the media Inlet, the media feeder including a tractor media feeder;

at least one trimming element in dose proximity to the media feeder for trimming the print media to a predetermined width prior to the print media entering the media inlet; and a drive source for operating moveable mechanisms of the printer, Including the media feeder and the trimming element, wherein the tractor media feeder includes:

a tractor roller;

a free roller; and a pair of tracks, each having a plurality of guide pins, encircling end portions of the tractor roller and the free roller for engaging and feeding the tractor media;

wherein the free roller acts as a media support for interacting with the trimming element to trim the fed tractor media.

6. A printer according to claim 5, wherein the free roller has an annular groove that allows the trimming element to ride therein to trim the tractor media.

* * * * *